United States Patent [19]

Stuart

[11] Patent Number: 5,000,807

[45] Date of Patent: Mar. 19, 1991

[54] APPARATUS AND METHOD FOR COMMINGLING CONTINUOUS MULTIFILAMENT YARNS

[75] Inventor: Lambert M. Stuart, North Kingstown, R.I.

[73] Assignee: Concordia Mfg. Co., Inc., Coventry, R.I.

[21] Appl. No.: 377,175

[22] Filed: Jul. 10, 1989

Related U.S. Application Data

[63] Continuation of Ser. No. 21,248, Mar. 3, 1987, abandoned.

[51] Int. Cl.[5] ..... B32B 31/00

[52] U.S. Cl. ..... 156/166; 28/282; 156/181; 156/273.1; 156/441

[58] Field of Search ..... 28/282; 156/181, 273.1, 156/166, 441; 19/299

[56] References Cited

U.S. PATENT DOCUMENTS

| | | | |
|---|---|---|---|
| 2,964,900 | 12/1960 | Hicks, Jr. | 57/209 |
| 3,117,888 | 1/1964 | Fox | 427/211 |
| 3,197,351 | 7/1965 | Selby | 156/181 |
| 3,328,850 | 7/1967 | Watson | 28/282 |
| 3,358,436 | 12/1967 | Niina et al. | 28/282 |
| 3,436,797 | 4/1969 | Graf et al. | 156/380.9 |
| 3,593,074 | 7/1971 | Isakoff | 361/230 |
| 3,739,566 | 6/1973 | Smith | 57/90 |
| 3,798,095 | 3/1974 | Hall | 28/282 |
| 3,873,389 | 3/1975 | Daniels | 156/181 |
| 4,271,570 | 6/1981 | Curzio | 28/290 |
| 4,539,249 | 9/1985 | Curzio | 428/175 |

FOREIGN PATENT DOCUMENTS 47-3861 2/1972 Japan .

OTHER PUBLICATIONS

"Operating Instructions for Interlace Tester Obestat".

*Primary Examiner*—George F. Lesmes
*Assistant Examiner*—J. Davis
*Attorney, Agent, or Firm*—Fish & Richardson

[57] ABSTRACT

Improving commingling two or more continuous multiple filament yarns into a single yarn by rubbing one yarn against a static charge-inducing body that is supported in an electrically isolated manner to apply static charge to the yarn to tend to cause separation of its individual multiple filaments.

29 Claims, 2 Drawing Sheets

APPARATUS AND METHOD FOR COMMINGLING CONTINUOUS MULTIFILAMENT YARNS

This application is a continuation of application Ser. No. 07/021,248, filed Mar. 3, 1987, now abandoned.

FIELD OF THE INVENTION

The invention relates to commingling two or more continuous multiple filament yarns into a single yarn.

BACKGROUND OF THE INVENTION

It is sometimes desirable to commingle or hybridize two or more continuous multiple filament yarns into a single yarn to provide the combined beneficial characteristics of the two different materials in a single yarn. Such commingled yarns make possible the manufacture of advanced thermoplastic composite parts in very complex shapes. For example, commingled carbon and polyether ether ketone (PEEK) yarns are desirable, because, in a mold under heat and pressure, the PEEK melts and flows around the carbon fibers, forming a lightweight, reinforced plastic without the complications of the more traditional wet epoxy and polyester resin systems.

Curzio U.S. Pat. No. 4,539,249 discloses combining graphite fibers from one spool with thermoplastic resin fibers from other spools by passing thermoplastic and graphite fibers through a guide plate, twisting these fibers and overwrapping these fibers with additional resin fibers from additional spools to provide a blended yarn.

SUMMARY OF THE INVENTION

It has been discovered that commingling of two or more different continuous multiple filament supply yarns can be improved by rubbing a difficult-to-separate supply yarn against a static charge-inducing body that is supported in an electrically isolated manner in order to apply a static charge to the yarn to tend to cause separation of the individual filaments before combining the supply yarns.

In preferred embodiments the supply Yarns are separately formed into opened ribbons in which at least some of the individual filaments are spaced from each other, and the opened ribbons are combined so as to cause interleaving and mixing of the different individual filaments; the yarn being charged travels around a plurality of motorized rollers in order to induce the static charge; the yarn being charged passes around a ribboning bar in order to spread out the charged filaments; the relative speeds of the yarns and the charge-inducing rollers are adjustable in order to vary the amount of charge applied to the yarn; a second yarn is formed into an opened ribbon using an air curtain; the two opened ribbons are combined together at a commingling bar; sizing is applied to the yarns after combining; and the yarns travel through the apparatus at greater than approximately 70 feet per minute (most preferably greater than approximately 100 feet per minute). Advantages are that the individual filaments in the commingled yarn remain parallel, the feed yarns are blended with a high degree of homogeneity, and the process is very economical.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

STRUCTURE

Figure 1:
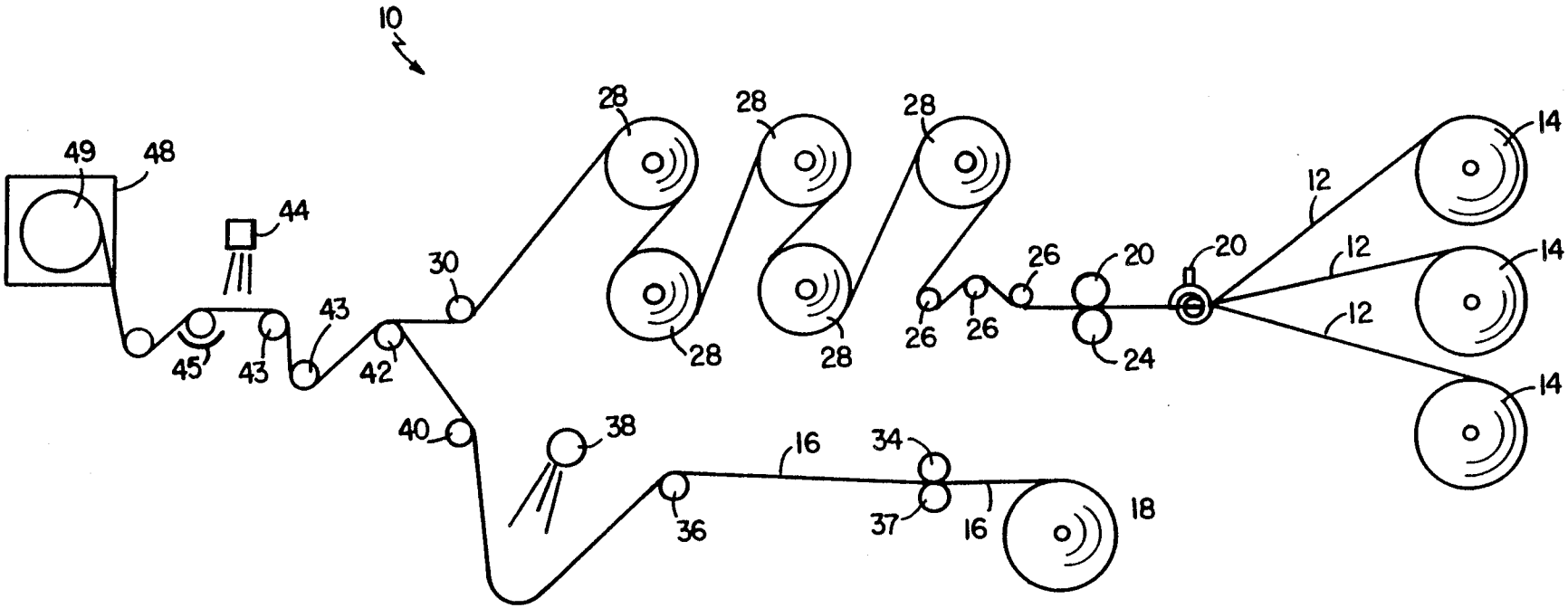
FIG. 1 is a schematic representation of commingling apparatus according to the invention.
Figure 2:
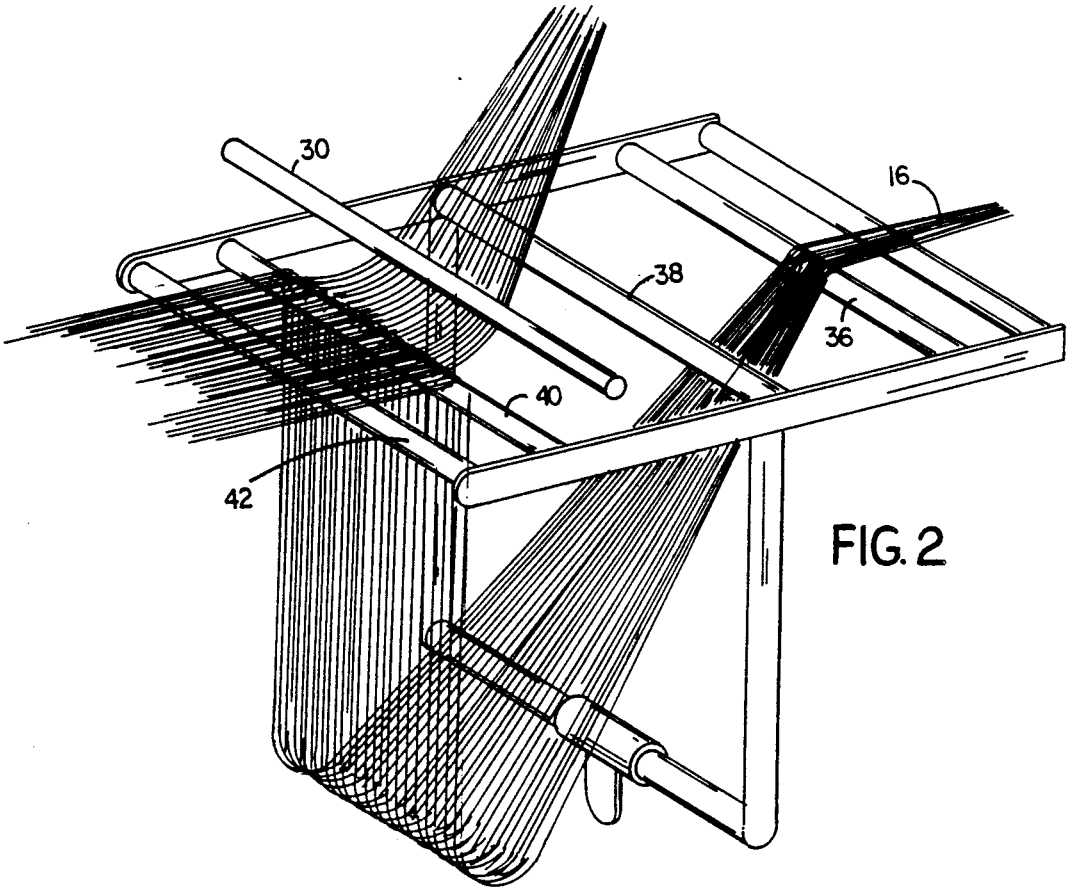
FIG. 2 is a perspective diagrammatic view showing air ribboning and commingling components of the FIG. 1 apparatus.
Figure 3:
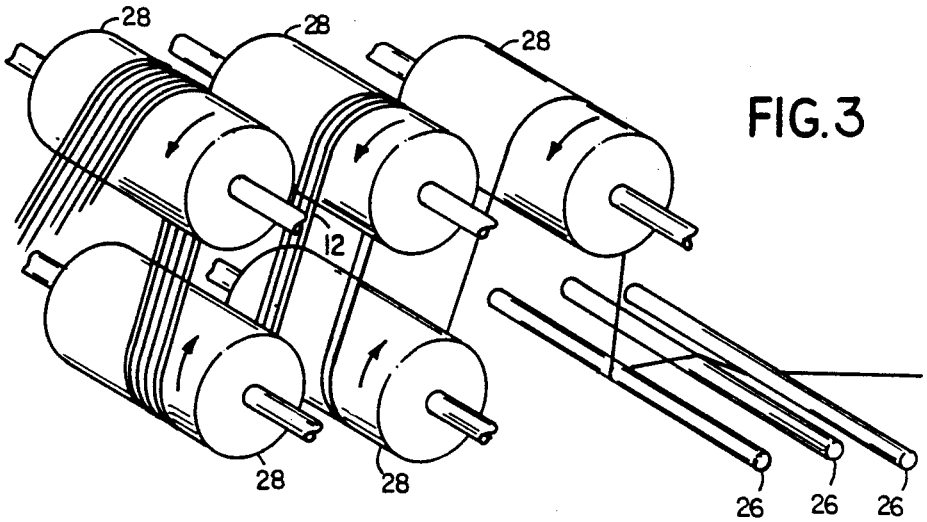
FIG. 3 is a perspective diagrammatic view of rollers of the FIG. 1 apparatus that are used for generating static electricity in a yarn to provide a flat opened ribbon according to the invention.

Referring to FIGS. 1–3, there is shown commingling apparatus 10 in use commingling polyether ether ketone (PEEK) continuous multiple filament yarns 12 from freely rotatable supply rolls 14 and continuous multiple filament graphite yarn 16 from freely rotatable supply roll 18. On the path of travel of PEEK yarn 12, apparatus 10 includes gathering guide 20, motor-driven pinch rollers 22, 24, three pretensioning bars 26, five motor-driven charge-inducing rollers 28 (1/32" thick virgin PTFE Teflon surface layers, available from DuPont, mounted on 4" steel support rollers), and ribboning bar 30. On the path of travel for graphite yarn 16, apparatus 10 includes driven shaft 32, idler shaft 34, supPort rod 36, air curtain element 38 (a tube connected to a source of pressurized air and having a single row of downwardly directed holes along its length), and support rod 40. Downstream of support rod 40 and ribboning bar 30 are commingling bar 42, two free-wheeling rollers 43, atomizer 44 (for spraying sizing onto the filaments), and take-up unit 48 (including a traversing mechanism not shown) for wrapping the commingled yarn on take-up roll 49. Rollers 28 are electrically isolated, to permit the static charges to build up on the yarn. Downstream of rollers 28, ribboning bar 30, commingling bar 42, and rollers 43 are grounded, permitting bleeding of the charges.

Pinch rolls 22, 24, driven shaft 32, and take-up unit 48 are driven by a common first drive system (not shown) to achieve the desired velocity of yarn through the apparatus. Rollers 28 are driven by a common second drive system (not shown) that provides variable speed from 0 to 200 feet per minute surface velocity, twice as fast as the typical yarn velocity of 100 feet per minute.

In the example shown in FIG. 1, three multiple filament yarns 12 from three rolls of PEEK (available from Celanese under the trade designation 300/100 SP-301A PEEK) were blended with one continuous filament graphite yarn 16 (3K unsized carbon tow available from BASF under the trade designation Celion) to provide the desired Proportion of the two.

Operation

In operation, in general, the continuous multiple filament PEEK yarns 12 and graPhite yarn 16 are separately opened up into flat opened ribbons, the flat opened ribbons are combined so as to have interleaving of different filaments, and the resulting combined flat ribbon is narrowed and wound up on the takeup roll. The graphite and PEEK yarns travel at approximately 100 feet per minute through apparatus 10.

Discussing the processing of PEEK yarns 12 first, the three yarns pass through and are combined at guide 20. From there they are driven between pinch rollers 22, 24 and through pretensioning bars 26 to rollers 28. Pretensioning bars 26 assist providing desired tension in the PEEK yarns as they travel past and around rollers 28. The PEEK yarn cannot be opened up by application of an air curtain and, therefore, is opened up by generating a static charge on it through the use of rollers 28. Rollers 28 are driven at speeds to cause relative travel between the PEEK filaments and the Teflon surface. Rolls 28 develop a charge that is opposite that developed in the PEEK fibers, causing the fibers to be attracted to the rollers, and increasing the tension in fibers 12 as they pass through the five rollers 28. (I.e., the attraction must be overcome in pulling the yarns off of the surfaces of the rollers.) Around 6000 volts is generated in passing through rollers 28, and the electrical charge applied to the yarn filaments causes them to repel each other. Because the cross-sectional configuration of the charged yarn leaving rolls 28 thus tends to be circular, the open filament bundle is drawn under ribboning bar 30 under tension to force the bundle into the shape of a flat opened ribbon. As is seen in FIG. 3, by the time the filaments leave ribboning bar 30, they are in parallel configuration, and the ribbon is approximately two to four inches wide. By varying the tension in the PEEK yarns and the speeds of rollers 28, the charge applied to the PEEK filaments can be adjusted as necessary to provide the desired opening of the individual filaments, and the desired width of the flat ribbon that matches that of the flat ribbon of graphite yarns. From ribboning bar 30, the flat opened ribbon of PEEK yarns passes over commingling bar 42.

Graphite yarn 16 travels from supply roll 18 between driven shaft 32 and idler shaft 34. Driven shaft 32 is driven at a speed equal to that of take-up roll 49 and pinch rolls 22, 24. The speed of driven shaft 32 can be adjusted if necessary to provide the loop between support rod 36 and support rod 40. The graphite yarn can be opened up into an open ribbon by the application of an air curtain, because the graphite fibers are not greatly attracted to each other. The pressurized curtain causes the loop to extend in the direction of air flow and the individual graphite filaments to separate so that the graphite yarn is in a flat opened ribbon state when it joins with the PEEK ribbon at the commingling bar 42.

At commingling bar 42, the opened ribbons of PEEK and graphite are joined together, and the different filaments are interleaved. From commingling bar 42, the combined flat opened ribbon passes under and over free-wheeling rollers 43 and past atomizer 44, at which sizing is sprayed to cause the individual filaments to tend to adhere to each other. By the time the PEEK filaments reach atomizer 44, the charges have been bled sufficiently to permit the fibers to be in close proximity to each other. At atomizer 44, the commingled yarn has about a 1 ½" width, which is reduced to about ⅛" to ¼" by the guide of take-up unit 48, which wraps the commingled yarn on take-up roll 49.

The commingled yarn can be stored indefinitely and used to produce woven, drapable, reinforced thermoplastic fabric on conventional equipment. In use in fabricating lightweight, reinforced thermoplastic products, heat and pressure is applied, and the PEEK flows around the reinforcing graphite fibers and bonds the graphite fibers together. The homogeneous nature of the commingled yarn provides intimate contact between the individual filaments of the component PEEK and graphite, thereby, providing improved wet out and bonding. The process is superior to other methods of assembling such yarns, for example, twisting and/or parallel winding, because the individual filaments of the component yarns are more homogeneously distributed throughout the resulting yarn. Because the yarn is commingled rather than layered, the component materials are more evenly distributed in the final product, resulting in better blending of reinforcing graphite fibers and resin matrix fibers, thereby producing superior products The speed of travel through apparatus 10 has an effect on the quality of the product, in particular its homogeneity. It was found that as the speed was increased from 20 fpm to around 70 fpm there was not much noticeable effect on homogeneity; at around 70 fpm, improvements in quality were first noted, and increasing speed from 70 to over 100 fpm resulted in further improvements in homogeneity. Continuing to increase speed above 100 fpm should improve homogeneity even further. It is believed that the increased speed promotes parallel PEEK filaments during travel to the commingling bar. One factor permitting the high speeds is that there are no mechanical separating elements, e.g., comb teeth, which would limit speed and potentially damage filaments.

OTHER EMBODIMENTS

Other embodiments of the invention are within the scope of the following claims. For example other yarns besides the PEEK and graphite, e.g., polyphenylene sulfide (PPS), can be used and commingled using apparatus 10. Also more or fewer rolls 28 can be used to provide the charge depending on the material, and a plurality of different yarns can be provided at supply rolls 14. Also each of the yarns being commingled could be rubbed against a static charge-inducing body prior to combining them. Also, instead of atomizer 44, sizing roll 45 (a roller partially located in a trough containing a sizing materials other than Teflon can be used in the static charge-inducing body.

What is claimed is:

1. A method of commingling two or more different continuous multiple filament yarns into a single yarn comprising continuously supplying separate first and second different continuous multiple filament yarns, rubbing said first yarn against a static charge-inducing body that is supported in an electrically isolated manner to apply static charge to said first yarn to tend to cause separation of individual multiple filaments of said first yarn, said body being a variable-speed rotatably-driven roll having a tangential speed that is in the same direction as and is faster than that of said filaments of said first yarn, all multiple filament strands of said first yarn proceeding in the same direction with respect to the direction of rotation of said roll, causing said first yarn to form a first opened ribbon, separately opening up said second multiple filament yarn to form a second opened ribbon, and combining said first and second ribbons so as to cause mixing of different individual filaments, said first yarn not being driven by any drive means after said rubbing against said static charge inducing body and prior to said combining said first and second yarns.

2. The method of claim 1 wherein said first yarn is made of nonconductive material, and said second yarn is made of conductive material.

3. The method of claim 2 wherein said first fibers are thermoplastic, and said second fibers are carbon fibers.

4. The method of claim 3 wherein said thermoplastic fibers are polyether ether ketone.

5. The method of claim 3 wherein said thermoplastic fibers are polyphenylene sulfide.

6. The method of claim 1 wherein said second yarn is opened into said opened ribbon using an air curtain directed to a loop of said filaments hanging between two supports.

7. The method of claim 1 wherein said combining of opened ribbons includes bringing them together over a commingling bar.

8. The method of claim 7 wherein said opening of said first yarn includes traveling under tension around a ribboning bar to spread out filaments that have said static charge on them.

9. The method of claim 1 further comprising applying sizing to said combined opened ribbon after said combining.

10. The method of claim 9 further comprising reducing the width of said combined opened ribbon after applying said sizing.

11. The method of claim 8 in which said yarns travel at greater than approximately 70 feet per minute.

12. The method of claim 11 in which said yarns travel at greater than approximately 100 feet per minute.

13. The method of claim 1 wherein said tangential speed is adjusted so as to control tension.

14. The method of claim 1 wherein said tangential speed is adjusted so as to control the amount of static charge.

15. The method of claim 1 wherein said rubbing includes rubbing against a plurality of variable-speed rotatably-driven rolls, said first yarn alternately contacting different sides of said rolls.

16. Apparatus for commingling two or more different continuous multiple filament yarns into a single yarn comprising supply means for continuously supplying separate first and second different continuous multiple filament yarns, a static charge-inducing body that is supported in an electrically isolated manner to apply static charge to said first yarn supplied from said supply means as said yarn travels past and rubs against said body to tend to cause separation of individual multiple filaments of said first yarn, said body being a variable-speed rotatably-driven roll capable of having a tangential speed that is in the same direction as and is faster than that of said filaments of said first yarn, all multiple filament strands of said first yarn proceeding in the same direction with respect to the direction of rotation of said roll, means for causing said first yarn to form a first opened ribbon, means for separately opening said second multiple filament yarn to provide a second opened ribbon, and means for combining said first and second ribbons so as to cause mixing of different individual filaments, said apparatus not having any drive means present along the path of said first yarn from said static charge inducing body to said means for combining.

17. The apparatus of claim 16 wherein said means for separately opening comprises means for providing an air curtain to open said second yarn.

18. The apparatus of claim 16 wherein said means for combining includes a commingling bar over which said first and second opened ribbons travel.

19. The apparatus of claim 18 further comprising a ribboning bar between said body and said commingling bar to spread out filaments of said first yarn that have said static charge applied to them.

20. The apparatus of claim 19 further comprising an atomizer for applying sizing to said combined opened ribbon after leaving said commingling bar.

21. The apparatus of claim 19 further comprising a sizing roll for applying sizing to said combined opened ribbon after leaving said commingling bar.

22. The apparatus of claim 18 wherein said commingling bar is grounded.

23. The apparatus of claim 19 wherein said commingling bar and said ribboning bar are grounded.

24. The apparatus of claim 19 in which said apparatus is capable of causing said yarns to travel through said apparatus at greater than approximately 70 feet per minute.

25. The apparatus of claim 24 in which said apparatus is capable of causing said yarns to travel through said apparatus at greater than approximately 100 feet per minute.

26. The apparatus of claim 16 where said first yarn is made of nonconductive material, and said second yarn is made of conductive material.

27. The apparatus of claim 16 wherein said tangential speed is adjusted so as to control tension.

28. The apparatus of claim 16 wherein said tangential speed is adjusted so as to control the amount of static charge.

29. The apparatus of claim 16 further comprising additional variable-speed rotatably-driven rolls, said first yarn alternately contacting different sides of said rolls.

* * * * *

UNITED STATES PATENT AND TRADEMARK OFFICE

CERTIFICATE OF CORRECTION

PATENT NO. : 5,000,807

DATED : March 19, 1991

INVENTOR(S) : Lambert M. Stuart

It is certified that error appears in the above-identified patent and that said Letters Patent is hereby corrected as shown below:

Col. 1, line 44, "Yarns" should be --yarns--.

Col. 2, line 31, "supPort" should be --support--.

Col. 2, line 58, "Proportion" should be --proportion--.

Col. 2, line 62, "graPhite" should be --graphite--.

Col. 4, line 11, insert --.-- at end of line.

Col. 4, line 40, after "sizing" insert --liquid) could be used to apply sizing to the yarns, and --

Signed and Sealed this

Twenty-second Day of December, 1992

*Attest:*

DOUGLAS B. COMER

*Attesting Officer*

*Acting Commissioner of Patents and Trademarks*